US008632071B2

(12) United States Patent
Inoue et al.

(10) Patent No.: US 8,632,071 B2
(45) Date of Patent: Jan. 21, 2014

(54) IMAGE FORMING APPARATUS

(75) Inventors: Naoki Inoue, Yokohama (JP); Nobuyuki Kobayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 13/076,964

(22) Filed: Mar. 31, 2011

(65) Prior Publication Data

US 2011/0280590 A1 Nov. 17, 2011

(30) Foreign Application Priority Data

May 14, 2010 (JP) ..... 2010-112663
Feb. 14, 2011 (JP) ..... 2011-029088

(51) Int. Cl.
*B65H 7/02* (2006.01)

(52) U.S. Cl.
USPC ..... 271/265.02; 399/21

(58) Field of Classification Search
USPC ..... 271/265.02, 258.01, 259, 265.03; 399/21, 22
See application file for complete search history.

(56) References Cited

U.S. PATENT DOCUMENTS 7,559,543 B2 7/2009 Moriyama et al.
7,957,687 B2 6/2011 Ito
2004/0175193 A1 9/2004 Taguchi et al.
2010/0080575 A1 4/2010 Park et al.
2010/0086318 A1 4/2010 Nishino

FOREIGN PATENT DOCUMENTS

CN 1524703 A 9/2004
CN 101086636 A 12/2007
CN 101274722 A 10/2008
JP 2858441 2/1999
JP 2002-182518 6/2002
JP 2004-198533 7/2004
JP 2010-006547 1/2010
KR 20100036088 A 4/2010

OTHER PUBLICATIONS

Office Action dated Jul. 31, 2013, in Chinese Application No. 2011110119070.5.

*Primary Examiner* — Michael McCullough
(74) *Attorney, Agent, or Firm* — Fitzpatrick, Cella, Harper & Scinto

(57) ABSTRACT

An image forming apparatus is provided that, even when a recording material is conveyed with a short interval between papers, reduces mistaken detection of a jam without reducing throughput of image formation. To accomplish this, when an interval between papers is not detected by a sensor that is disposed upstream in a conveyance direction but is detected by a sensor that is disposed downstream in the conveyance direction, there is a high possibility of determining that a jam has been generated in which recording material wraps around a fixing roller, but even in such a case, discharge processing is executed normally without a determination that a jam has been generated in which recording material has wrapped around a fixing roller, by using a recording material size and a time period of detection of the interval between papers.

16 Claims, 8 Drawing Sheets

IMAGE FORMING APPARATUS

BACKGROUND OF THE INVENTION

1. Field of the Invention

The present invention relates to an image forming apparatus.

2. Description of the Related Art

In the specification of Japanese Patent No. 2858441, an image forming apparatus is proposed that detects a jam generated when a recording material unintentionally wraps around a fixing unit.

Specifically, in this image forming apparatus, sensors for detecting the recording material are provided on an upstream side and a downstream side relative to the fixing unit in a conveyance direction of the recording material. Using these two sensors, the image forming apparatus determines that a jam in which the recording material wraps around the fixing unit has been generated when, while the upstream-side sensor is detecting the recording material, the downstream-side sensor changes from a state of detecting the recording material to a state of not detecting the recording material before passage of a predetermined time period in which a trailing edge of the recording material is expected to pass the downstream-side sensor.

However, in the above conventional technology, there are the problems described below. For example, an image forming apparatus sometimes has a configuration whereby there is a difference between an interval from the trailing edge of a preceding recording material to the leading edge of a subsequent recording material (referred to below as an interval between papers) that can be detected by the sensor on the upstream side in the conveyance direction relative to the fixing unit, and an interval between papers that can be detected by the sensor on the downstream side in the conveyance direction. In particular, in image forming apparatuses, there has recently been a tendency to set a shorter interval between papers than in the prior technology in order to improve throughput. In such a case, when an interval between papers fails to be detected with an upstream-side registration sensor for detecting recording material that has been fed, but the interval between papers is detected with a discharge sensor on the downstream side for detecting that recording material has been discharged outside of the image forming apparatus, there is a possibility that even though the recording material is being conveyed normally with a short interval between papers, it may be incorrectly judged that a jam in which recording paper wraps around the fixing unit has been generated.

SUMMARY OF THE INVENTION

The present invention was made in consideration of the above problems, and aims to provide an image forming apparatus that, even when a recording material is conveyed with a short interval between papers, reduces mistaken detection of a jam without reducing throughput of image formation.

One aspect of the present invention provides an image forming apparatus, comprising: a first detection unit that, when a plurality of recording materials are continuously conveyed, detects an interval between a trailing edge of a preceding conveyed recording material and a leading edge of a next subsequently conveyed recording material; a second detection unit that is disposed on a downstream side in a conveyance direction of the recording material relative to the first detection unit, and is capable of detecting a shorter interval than that the first detection unit can detect; a setting unit that, after the leading edge of the subsequently conveyed recording material has been detected by the second detection unit, sets information indicating generation of a jam of the subsequently conveyed recording material; and a control unit that determines whether or not a jam has been generated based on the information that has been set by the setting unit when the interval has not been detected by the first detection unit and the interval has been detected by the second detection unit, and thereafter the subsequently conveyed recording material is no longer detected by the second detection unit.

Another aspect of the present invention provides an image forming apparatus, comprising: a first detection unit that, when a plurality of recording materials are continuously conveyed, detects an interval between a trailing edge of a preceding conveyed recording material and a leading edge of a next subsequently conveyed recording material; a second detection unit that is disposed on a downstream side in a conveyance direction of the recording material relative to the first detection unit, and is capable of detecting a shorter interval than that the first detection unit can detect; a measurement unit that measures a time period that the recording material has been detected by the first detection unit or the second detection unit; and a control unit that, when the interval has not been detected by the first detection unit and the trailing edge of the preceding conveyed recording material has been detected by the second detection unit, uses the measurement unit to measure the time period from detection of the trailing edge of the preceding conveyed recording material until detection of the leading edge of the subsequently conveyed recording material, and determines whether or not a jam has been generated according to the measured time period.

Further features of the present invention will be apparent from the following description of exemplary embodiments with reference to the attached drawings.

DESCRIPTION OF THE EMBODIMENTS

Figure 1:
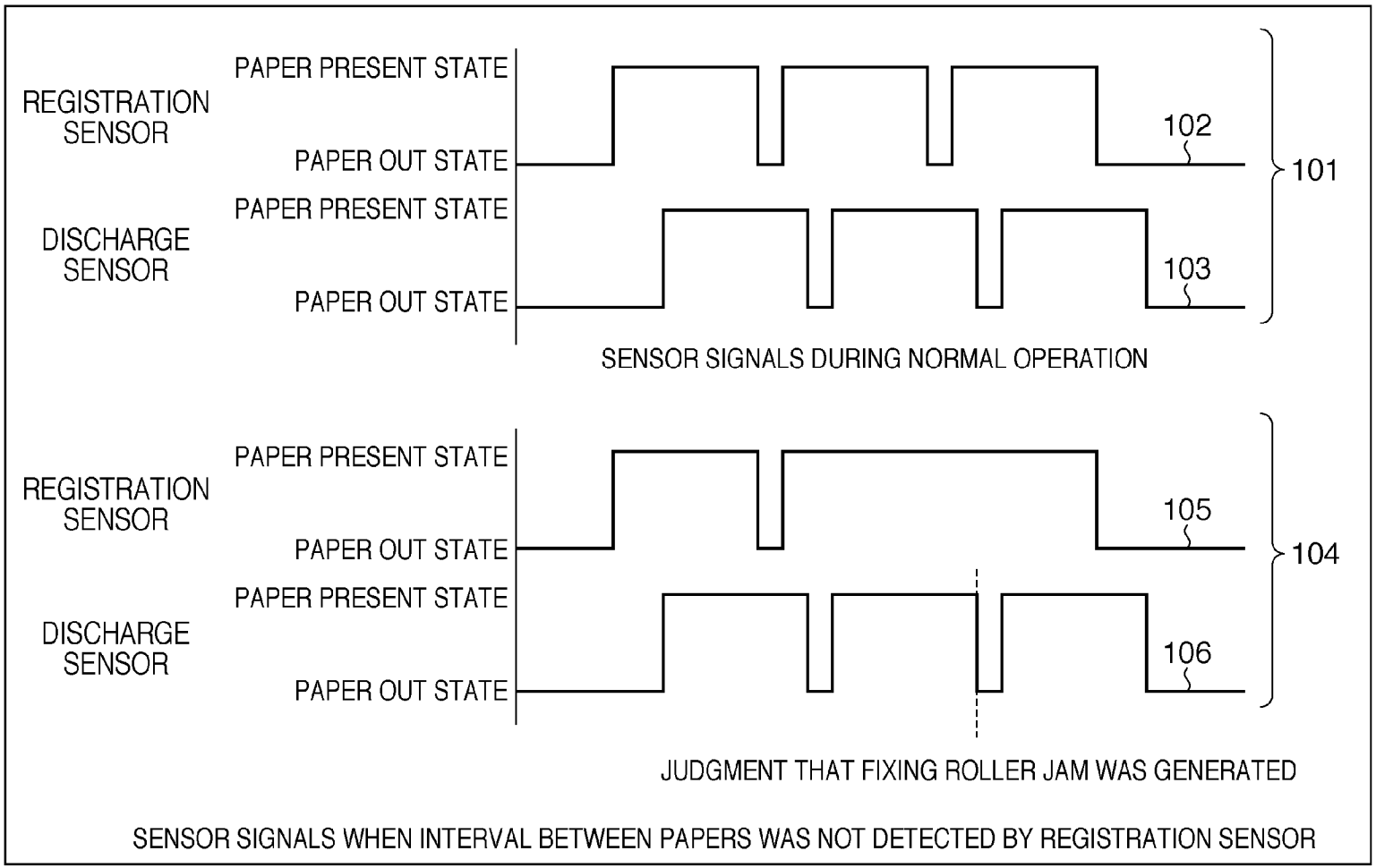
FIG. 1 shows sensor signals when three recording materials were printed.

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Below is a description of a first embodiment according to the present invention. An image forming apparatus according to the present embodiment is provided with sensors for detecting paper used as a recording material on an upstream side and a downstream side in a recording material conveyance direction relative to a fixing roller. Based on the detection state of these two sensors, a determination is made of whether or not a jam in which the recording material wraps around the fixing roller (referred to below as a fixing roller jam) has been generated. In the present embodiment, an example method for determining this fixing roller jam will be described.

Here, problems in an image forming apparatus according to a comparative example will be described with reference to FIG. 1. A timing chart 101 shows a sensor signal 102 of a registration sensor and a sensor signal 103 of a discharge sensor when it is judged that recording material conveyance is occurring normally in the image forming apparatus of the comparative example. A timing chart 104 shows a sensor signal 105 of the registration sensor and a sensor signal 106 of the discharge sensor when it is judged that a fixing roller jam has been generated during the recording material conveyance in the image forming apparatus of the comparative example.

In such an existing image forming apparatus, there is a tendency to shorten an interval between papers in order to improve the throughput during image formation. Here, an interval between papers indicates an interval from the trailing edge of a preceding paper of the recording material to the leading edge of a subsequent paper of the recording material. As shown in the timing chart 104, in the image forming apparatus of the comparative example, there is a difference between the performance of the registration sensor and that of the discharge sensor, and thus a state can occur in which a certain interval between papers cannot be detected by the registration sensor, but can be detected by the discharge sensor. In such a case, the image forming apparatus of the comparative example judges that a fixing roller jam has been generated. However, actually the recording material is being conveyed with a small interval between papers and a jam has not been generated, so this determination that a fixing roller jam has been generated is mistaken detection. In the present embodiment, a method for reducing such mistaken detection of a jam is described in detail below.

Configuration of Image Forming Apparatus

Figure 2:
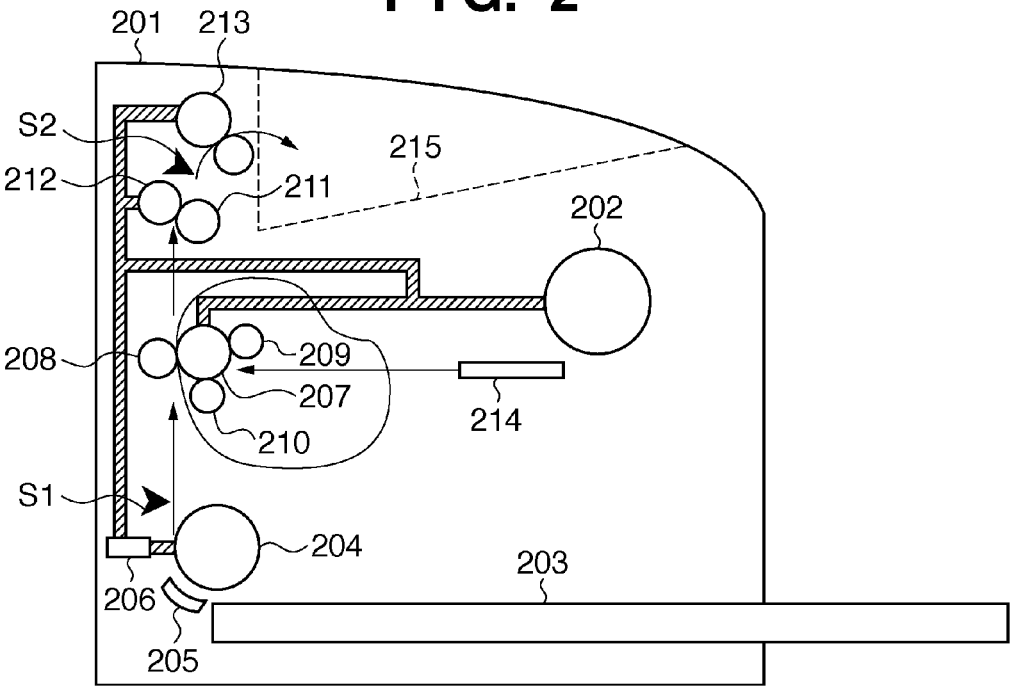
FIG. 2 is a cross-sectional view that shows an example configuration of an image forming apparatus according to a first embodiment.

Next is a description of the configuration of the image forming apparatus of the present embodiment, with reference to FIG. 2. Reference numeral 201 denotes an electrophotographic image forming apparatus. The image forming apparatus 201 includes a main motor 202, a feed tray 203, a feed roller 204, a separation pad 205, a feed solenoid 206, a photosensitive drum 207, a transfer roller 208, a fixing roller 211, a pressure roller 212, a discharge roller 213, a laser scanning unit 214, and a discharge tray 215.

The main motor 202 is a motor for rotationally driving components within the image forming apparatus 201. The feed tray 203 stores a recording material on which images will be formed. The feed roller 204 is a roller for picking up, paper-by-paper, the recording material that has been stored in the feed tray 203. By performing control to put the feed solenoid 206 in a transmissible state, rotational force from the drive power of the main motor 202 is applied to the feed roller 204. The separation pad 205 separates and conveys, paper-by-paper, the recording material that has been picked up from the feed tray 203 by the feed roller 204, such that that recording material is not double-fed. The recording material that has been fed by the feed roller 204 first passes by a registration sensor (a first sensor) S1.

The photosensitive drum 207 is charged to a predetermined potential by a charging roller 209 to which a charging voltage is applied from a high-voltage power source 216, and the laser scanning unit 214 irradiates a laser beam onto the photosensitive drum 207, and thereby an electrostatic latent image is formed. Furthermore, the electrostatic latent image is developed using a toner, by a development roller 210 to which a development voltage is applied from the high-voltage power source 216. In order to transfer the toner image on the photosensitive drum 207 to the recording material, a transfer voltage is applied to the transfer roller 208 from the high-voltage power source 216.

A ceramic heater for thermally fixing a toner image onto the recording material is provided inside of the fixing roller 211. The fixing roller 211 thermally fixes the toner image onto the recording material in a nip portion where the fixing roller 211 contacts the pressure roller 212, which is provided at a position facing the fixing roller 211. The recording paper that has undergone thermal fixing passes by a discharge sensor (a second sensor) S2. According to the image forming apparatus 201 of the present embodiment, the discharge sensor S2 is disposed on the downstream side in the conveyance direction of the recording material relative to the registration sensor S1. The fixing roller 211 is provided between the registration sensor S1 and the discharge sensor S2. The registration sensor S1 and the discharge sensor S2 are sensors that detect the presence/absence of the recording material, and are capable of, for example, when the recording material is being continuously conveyed, detecting an interval between papers when a change from a recording material present state to a recording material out state has been detected, or when a change from a recording material out state to a recording material present state has been detected. Also, note that the discharge sensor S2 used in the present embodiment is capable of detecting an interval between papers that is shorter than the interval between papers that can be detected by the registration sensor S1. When this sort of configuration is adopted, a case may occur in which an interval between papers cannot be detected by the registration sensor S1 but can be detected by the discharge sensor S2.

The discharge roller 213 discharges, to the discharge tray 215, the recording material to which a toner image has been fixed by receiving application of pressure and heat by the fixing roller 211 and the pressure roller 212. As indicated by the diagonal shading in FIG. 2, drive power from the main motor 202 is applied to the photosensitive drum 207, the pressure roller 212, the discharge roller 213, and the feed roller 204, thus causing those components to rotate.

Control Configuration

Figure 3:
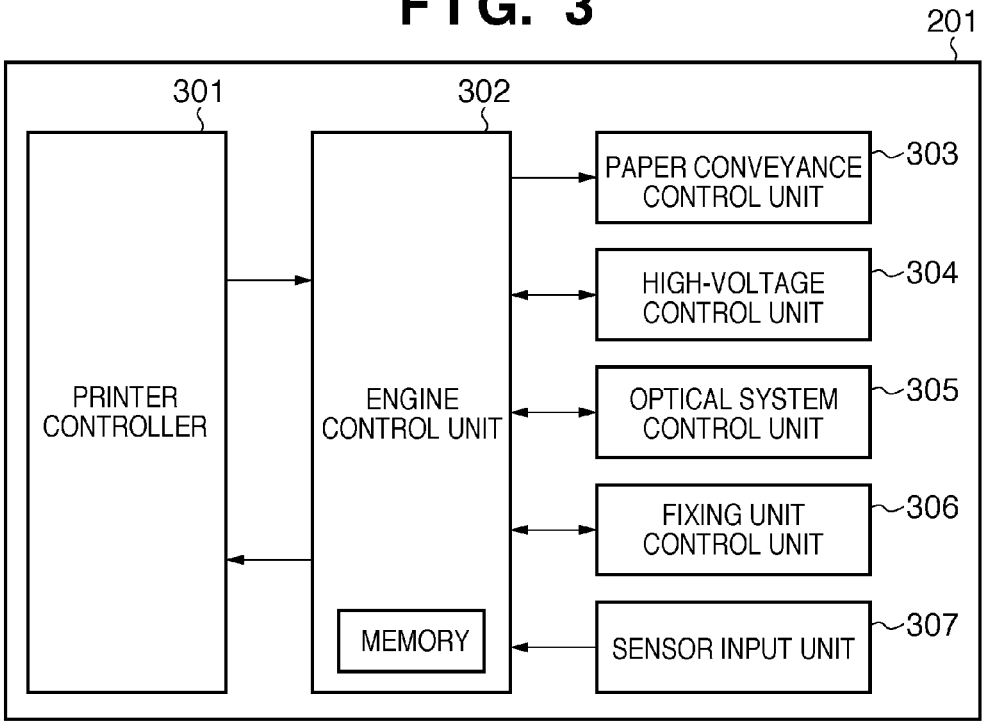
FIG. 3 is a block diagram that shows an example control configuration of the image forming apparatus according to the first embodiment.

Next is a description of a control configuration for controlling the configuration shown in FIG. 2, with reference to FIG. 3. The image forming apparatus 201 is provided with a printer controller 301, an engine control unit 302, a paper conveyance control unit 303, a high-voltage control unit 304, an optical system control unit 305, a fixing unit control unit 306, and a sensor input unit 307.

The printer controller 301 converts image data input from an external device such as a host computer to bit data necessary for printing by a printer, reads internal information of the printer via communications or the like, and displays that information on a display unit. The engine control unit 302 performs operation control of each component of a printer engine according to instructions by the printer controller 301, and reports the internal information of the printer to the printer controller 301. Also, a memory is provided within the engine control unit 302, and this memory stores a drive status of each control unit, counters, and so forth.

The paper conveyance control unit 303, according to instructions by the engine control unit 302, controls driving and stoppage of the motor, rollers, and so forth for recording material conveyance. The high-voltage control unit 304 performs control of the respective high-voltage outputs for charging, development, and transfer, according to instructions by the engine control unit 302. The optical system control unit 305 performs driving/stoppage of a scanner motor, and switching on/off of a laser, based on instructions by the engine control unit 302. The fixing unit control unit 306 drives/stops application of power to the fixing heater, according to instructions by the engine control unit 302. The sensor input unit 307 allows transmission of information of the registration sensor S1, the discharge sensor S2, and so forth to the engine control unit 302.

Jam Determination Method

Figure 4A:
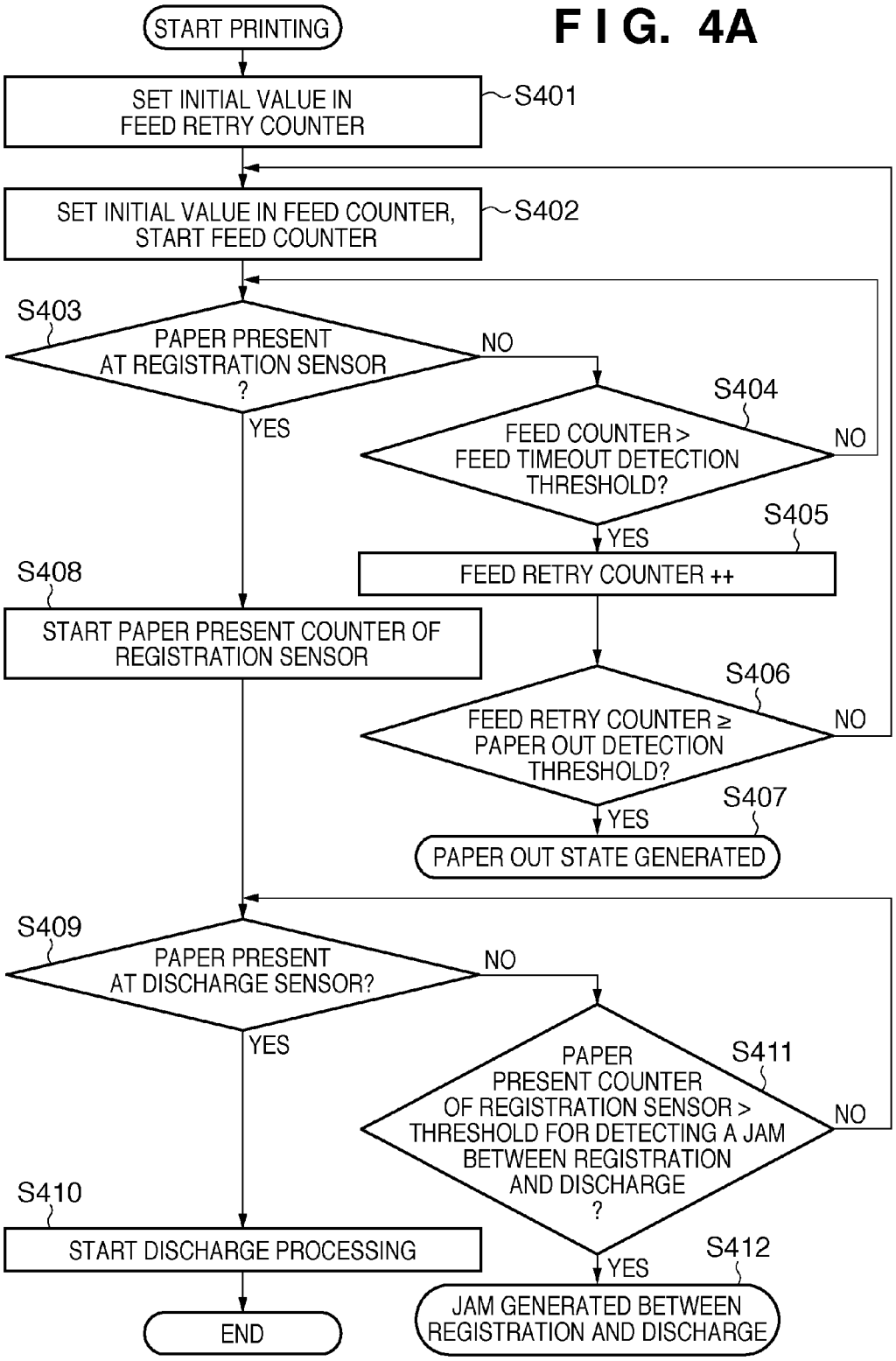
FIG. 4A is a flowchart that shows a method for determining a jam in feed-conveyance processing according to the first embodiment.
Figure 4B:
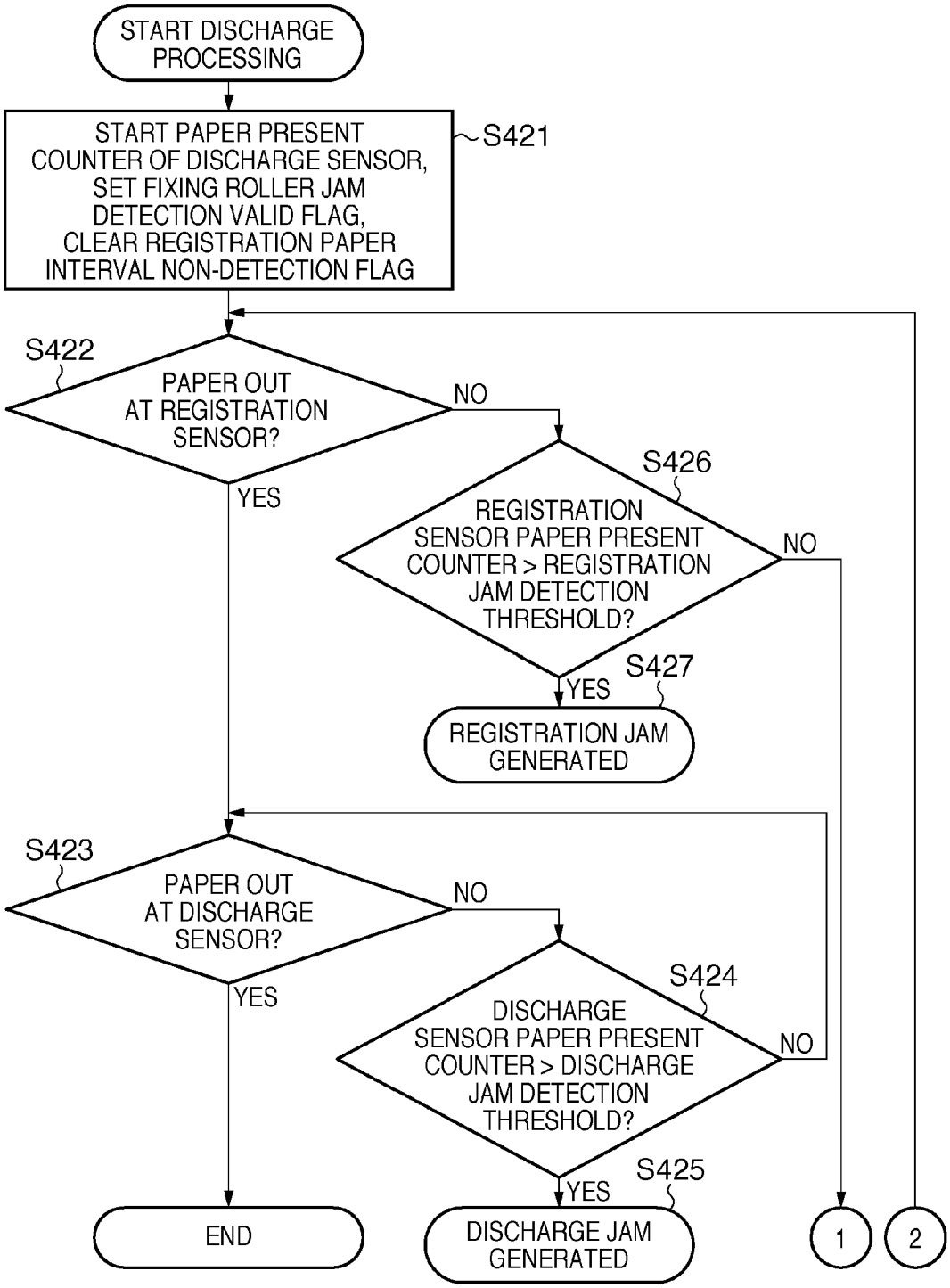
FIGS. 4B and 4C are a flowchart that shows a method for determining a jam in discharge processing according to the first embodiment.

Next, with reference to FIGS. 4A and 4B, is a description of a processing procedure executed by the engine control unit 302 of the present embodiment in order to determine whether to enable discharge of the recording material, or to stop discharge of the recording material because a jam has been generated. The flowchart in FIG. 4A shows feed-conveyance processing in which the recording material that has been loaded in the feed tray 203 is fed and conveyed until a leading edge of the recording material arrives at the discharge sensor. This processing is started when printing is started.

First, in step S401, the engine control unit 302, when instructed by the printer controller 301 to perform printing, sets an initial value in a feed retry counter. The feed retry counter is a counter that stores the number of times that feeding has been executed, and is incremented each time that feeding is executed. Next, in step S402, the engine control unit 302 sets an initial value in a feed counter, executes feeding, and starts a feed counter. The feed counter is a counter for measuring elapsed time after feeding execution, and is incremented at each occurrence of a certain time period.

Next, in step S403, the engine control unit 302 determines whether or not the leading edge of the recording material is being detected by the registration sensor S1. Here, if the leading edge of the recording material is not being detected, processing proceeds to step S404, and if the leading edge of the recording material is being detected, processing proceeds to step S408. In step S404, the engine control unit 302 compares the feed counter to a feed timeout detection threshold. The feed timeout detection threshold is a value determined according to a recording material conveyance time (which depends on the length and conveyance speed of the recording material) that corresponds to a length from the recording material leading edge position of the feed tray to the leading edge detection position of the registration sensor S1, and a margin amount. When the feed counter has not reached the feed timeout detection threshold, processing returns to step S403, and when the feed counter has reached the feed timeout detection threshold, processing proceeds to step S405.

In step S405, the engine control unit 302 judges that feeding was not performed normally, and increments the feed retry counter. Next, in step S406, the engine control unit 302 determines whether or not the feed retry counter has reached a recording material out detection threshold. The recording material out detection threshold is a threshold for judging that a recording material out state has been generated, and is a value determined according to performance of the feed roller, paper type of the recording material, and so forth. Here, when the feed retry counter has reached the recording material out detection threshold, processing proceeds to step S407, and when the feed retry counter has not reached the recording material out detection threshold, processing returns to step S402. In step S407, feeding is not possible even if feed processing is executed a predetermined number of times, so the engine control unit 302 judges that a recording material out state has been generated, and ends the feed-conveyance processing.

On the other hand, when the leading edge of the recording material, that is, a recording material present state, is being detected by the registration sensor S1 in step S403, in step S408, the engine control unit 302 starts a paper present counter at the registration sensor S1. The paper present counter is a counter for measuring the time period that a paper present state is being detected by the registration sensor S1, and is incremented at each occurrence of a certain time period.

Next, in step S409, the engine control unit 302 determines whether or not the leading edge of the recording material, that is, a recording material present state, is being detected by the discharge sensor S2. Here, when a recording material present state is being detected, processing proceeds to step S410, where discharge processing shown in FIGS. 4B and 4C is started, and then feed-conveyance processing is ended.

On the other hand, when a recording material present state is not being detected, processing proceeds to step S411, where the engine control unit 302 compares the paper present counter of the registration sensor S1 to a threshold for detecting a jam between registration and discharge. The threshold for detecting a jam between registration and discharge is a threshold for judging that a jam has been generated between the registration sensor S1 and the discharge sensor S2. Also, this threshold is a value determined according to a recording material conveyance time (which depends on the length and conveyance speed of the recording material) that corresponds to a length from the leading edge detection position of the registration sensor S1 to the leading edge detection position of the discharge sensor S2, and a margin amount. When the paper present counter of the registration sensor S1 has not reached the threshold for detecting a jam between registration and discharge, processing returns to step S409. On the other hand, when the paper present counter of the registration sensor S1 has reached the threshold for detecting a jam between registration and discharge, processing proceeds to step S412, where the engine control unit 302 judges that a jam has been generated between the registration sensor S1 and the discharge sensor S2, and then feed-conveyance processing is ended.

Figure 4C:
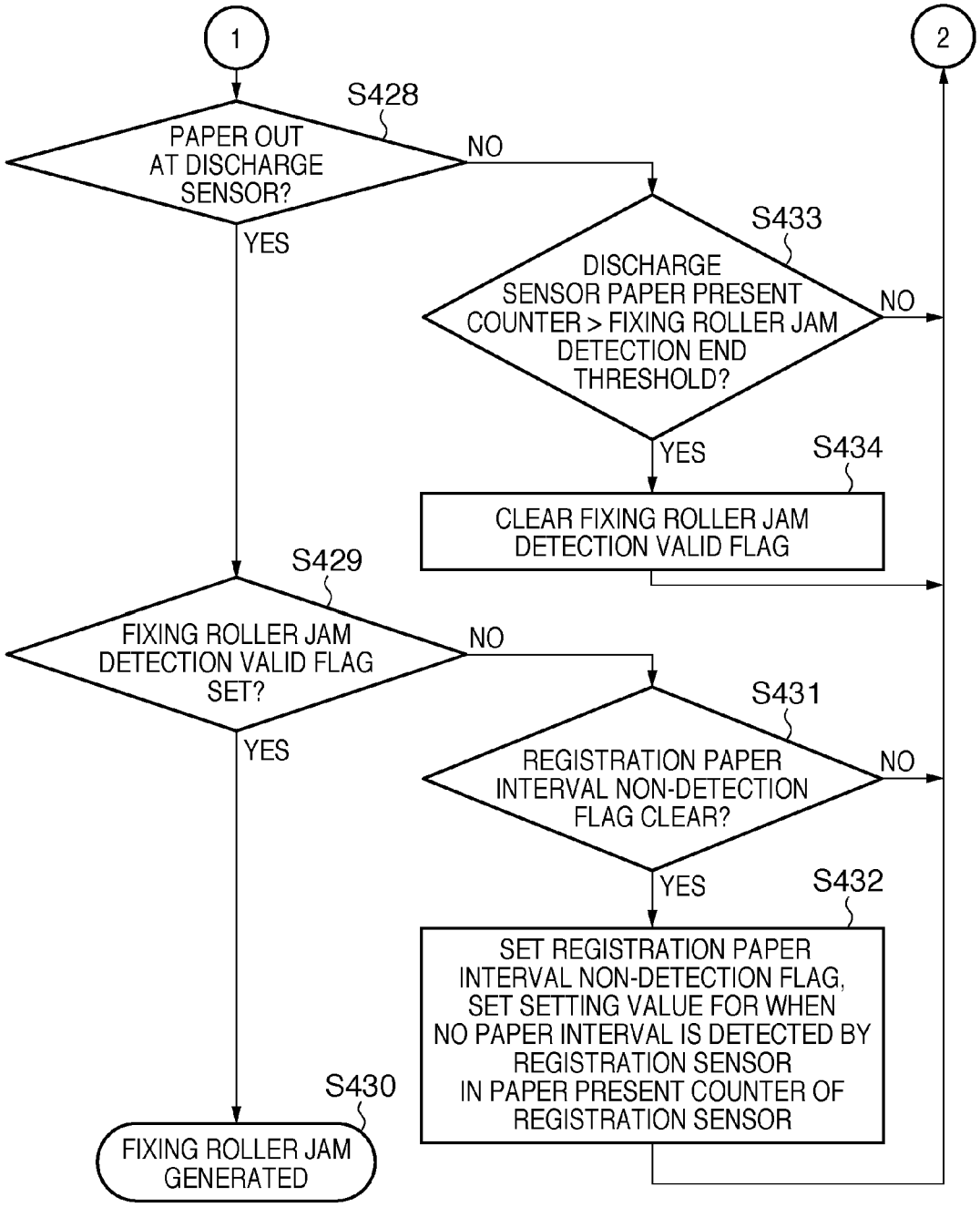

The flowchart shown in FIGS. 4B and 4C shows discharge processing for discharging the recording material from within the image forming apparatus 201. This flowchart is started by step S410 in FIG. 4A. First, in step S421, the engine control unit 302 starts a paper present counter of the discharge sensor S2, sets a detection valid flag regarding detection of a fixing roller jam to the fixing roller 211, and clears a registration paper interval non-detection flag. The paper present counter at the discharge sensor S2 is a counter for measuring the time period that a paper present state is being detected by the discharge sensor S2, and is incremented at each occurrence of a certain time period. The detection valid flag regarding detection of a fixing roller jam is a flag that indicates whether or not to make valid the detection control regarding a fixing roller jam to the fixing roller 211. The registration paper interval non-detection flag indicates that an interval between papers was not detected by the registration sensor S1, but was detected by the discharge sensor S2, and is a flag for resetting the paper present counter of the registration sensor S1. Because the leading edge of the recording material was detected by the discharge sensor S2, the paper present counter of the discharge sensor starts measurement. The detection valid flag for determining generation of a fixing roller jam is set in order to determine whether or not the recording material is wrapped around the fixing unit. When this detection valid flag is set, the engine control unit 302 judges that a fixing roller jam has been generated, and when this detection valid flag is not set, the engine control unit 302 judges that a fixing roller jam has not been generated.

Next, in step S422, the engine control unit 302 determines whether or not the trailing edge of the recording material was detected by the registration sensor S1. That is, here, the engine control unit 302 determines whether or not an output signal of the registration sensor S1 indicates a recording material out state. When a recording material out state was determined, processing proceeds to step S423. When a recording material present state was determined, processing proceeds to step S426. In step S423, the engine control unit 302 determines whether or not the trailing edge of the recording material was detected by the discharge sensor S2. That is, here, the engine control unit 302 determines whether or not an output signal of the discharge sensor S2 indicates a recording material out state. Here, when a recording material out state was determined, the engine control unit 302 judges that the recording material was normally discharged outside of the image forming apparatus, and ends the discharge processing.

On the other hand, when a recording material present state was determined in step S423, processing proceeds to step S424, where the engine control unit 302 compares the paper present counter of the discharge sensor S2 to a discharge jam detection threshold. The discharge jam detection threshold indicates whether or not jam generation was detected in the vicinity of the discharge sensor S2, and is a value determined according to a recording material conveyance time (which depends on the length and conveyance speed of the recording material), and a margin amount. When the paper present counter of the discharge sensor S2 has not reached the discharge jam detection threshold, processing returns to step S423. On the other hand, when the paper present counter of the discharge sensor S2 has reached the discharge jam detection threshold, processing proceeds to step S425, where the engine control unit 302 judges that a jam was generated in the vicinity of the discharge sensor S2, and ends the discharge processing. That is, if a recording material present state is detected by the discharge sensor S2 even after the discharge jam detection threshold has passed, the engine control unit 302 judges that a discharge congestion jam has been generated.

When a recording material present state was determined in step S422 based on the output signal of the registration sensor S1, processing proceeds to step S426, where the engine control unit 302 compares the paper present counter of the registration sensor S1 to a registration jam detection threshold. The registration jam detection threshold indicates whether or not jam generation was detected in the vicinity of the registration sensor S1, and is a value determined according to a recording material conveyance time (which depends on the length and conveyance speed of the recording material), and a margin amount. Also, the registration jam detection threshold is set to a value that is greater than the sum of a recording material conveyance time that corresponds to a length from the leading edge detection position of the registration sensor S1 to the leading edge detection position of the discharge sensor S2, and a detection end threshold of a fixing roller jam to the fixing roller 211.

Here, when the paper present counter of the registration sensor S1 has reached the registration jam detection threshold, processing proceeds to step S427, where the engine control unit 302 judges that a jam has been generated in the vicinity of the registration sensor S1, and ends the discharge processing. That is, if a recording material present state is detected by the registration sensor S1 even after the registration jam detection threshold has passed, the engine control unit 302 judges that a registration congestion jam has been generated. On the other hand, when the paper present counter of the registration sensor S1 has not reached the registration jam detection threshold, processing proceeds to step S428, where the engine control unit 302 determines whether or not the trailing edge of the recording material is being detected by the discharge sensor S2. That is, here, the engine control unit 302 determines whether or not the output signal of the discharge sensor S2 is indicating a recording material out state. In the case of a recording material out state, processing proceeds to step S429, where the engine control unit 302 determines whether or not the detection valid flag for detection of a fixing roller jam to the fixing roller 211 is set (is on or off).

If the detection valid flag for detection of a fixing roller jam to the fixing roller 211 is set, processing proceeds to step S430, where the engine control unit 302 judges that a fixing roller jam to the fixing roller 211 has been generated, and ends the discharge processing. On the other hand, if the detection valid flag for detection of a fixing roller jam to the fixing roller 211 is not set, processing proceeds to step S431.

In step S431, the engine control unit 302 determines whether or not the registration paper interval non-detection flag is clear (unset). Here, if the registration paper interval non-detection flag is clear, processing proceeds to step S432, where the engine control unit 302 sets the registration paper interval non-detection flag, and in order to not cause generation of a registration jam, sets a setting value for when no paper interval is detected by the registration sensor S1 in the paper present counter of the registration sensor S1. The setting value for when no paper interval is detected by the registration sensor S1 is a value determined according to a recording material conveyance time that corresponds to a length from the leading edge detection position of the registration sensor S1 to the leading edge detection position of the discharge sensor S2, and a margin amount. On the other hand, if the registration paper interval non-detection flag is set, processing returns to step S422.

When it is determined in step S428 that the output signal of the discharge sensor S2 is indicating a recording material present state, in step S433, the engine control unit 302 compares the paper present counter of the discharge sensor S2 to a detection end threshold of a fixing roller jam to the fixing roller 211. The detection end threshold of a fixing roller jam to the fixing roller 211 is a value determined according to a recording material conveyance time (which depends on the length and conveyance speed of the recording material), and a margin amount. Note that a negative value is used for this margin amount. That is, the fixing roller jam detection end threshold defines a jam determination valid time following detection of the leading edge of a preceding paper of the recording material by the discharge sensor S2.

Here, when the paper present counter of the discharge sensor S2 has reached the detection end threshold of a fixing roller jam to the fixing roller 211, processing proceeds to step S434, where the engine control unit 302 clears the fixing roller jam detection valid flag in order to make detection of a fixing roller jam to the fixing roller 211 invalid, and processing returns to step S422. On the other hand, when the paper present counter of the discharge sensor S2 has not reached the detection end threshold of a fixing roller jam to the fixing roller 211, detection of a fixing roller jam is left valid, and processing returns to step S422.

By using the above jam determination method, it is possible to prevent mistaken detection of a fixing roller jam to the fixing roller 211 as illustrated in FIG. 1. Specifically, in a circumstance in which the registration sensor S1 is detecting a recording material present state in step S422, and the discharge sensor S2 is detecting a recording material present state in step S428, the fixing roller jam detection valid flag of detection of a fixing roller jam to the fixing roller 211 according to the length of the recording material is cleared in step S434. Thus, when the discharge sensor S2 has detected a recording material out state, there is not judged to be generation of a fixing roller jam to the fixing roller 211 in step S429, so conveyance can be continued. That is, a period is provided in which detection (determination results) of a fixing roller jam to the fixing roller 211 is made invalid when an interval between papers has not been detected by the registration sensor S1, but has been detected by the discharge sensor S2, according to the length of the recording material. Moreover, by resetting the paper present counter of the registration sensor S1 in step S432, there is no judgment that there has been generation of a registration jam due to the registration sensor S1 being unable to detect an interval between papers in step S426, and so conveyance can be continued. Also note that here, by way of example, a method is disclosed in which a fixing roller jam is determined to have been generated when the detection valid flag is set, but by reversing all settings of the detection valid flag, it is also possible to determine that a fixing roller jam has been generated when the detection valid flag has not been set.

As described above, according to the image forming apparatus 201 of the present embodiment, when an interval between consecutively conveyed recording materials cannot be detected by the registration sensor S1, but can be detected by the discharge sensor S2, mistaken detection of a jam can be reduced. Also, in the present embodiment, even in a case where an interval between papers has not been detected by the registration sensor S1, but has been detected by the discharge sensor S2, it is possible to prevent mistaken detection of a fixing roller jam to the fixing roller 211 using the paper out detection time of the discharge sensor S2. Also, in the present embodiment, for the respective thresholds, a recording material conveyance time that corresponds to the length in the conveyance direction of the recording material is used. Regarding the method for measuring that recording material conveyance time, measurement may be performed using a detection sensor that detects the recording material length, or the length of the recording material may be measured with the registration sensor S1 or the discharge sensor S2. Alternatively, a recording material length that has been designated by a user may be used.

Second Embodiment

Figure 5A:
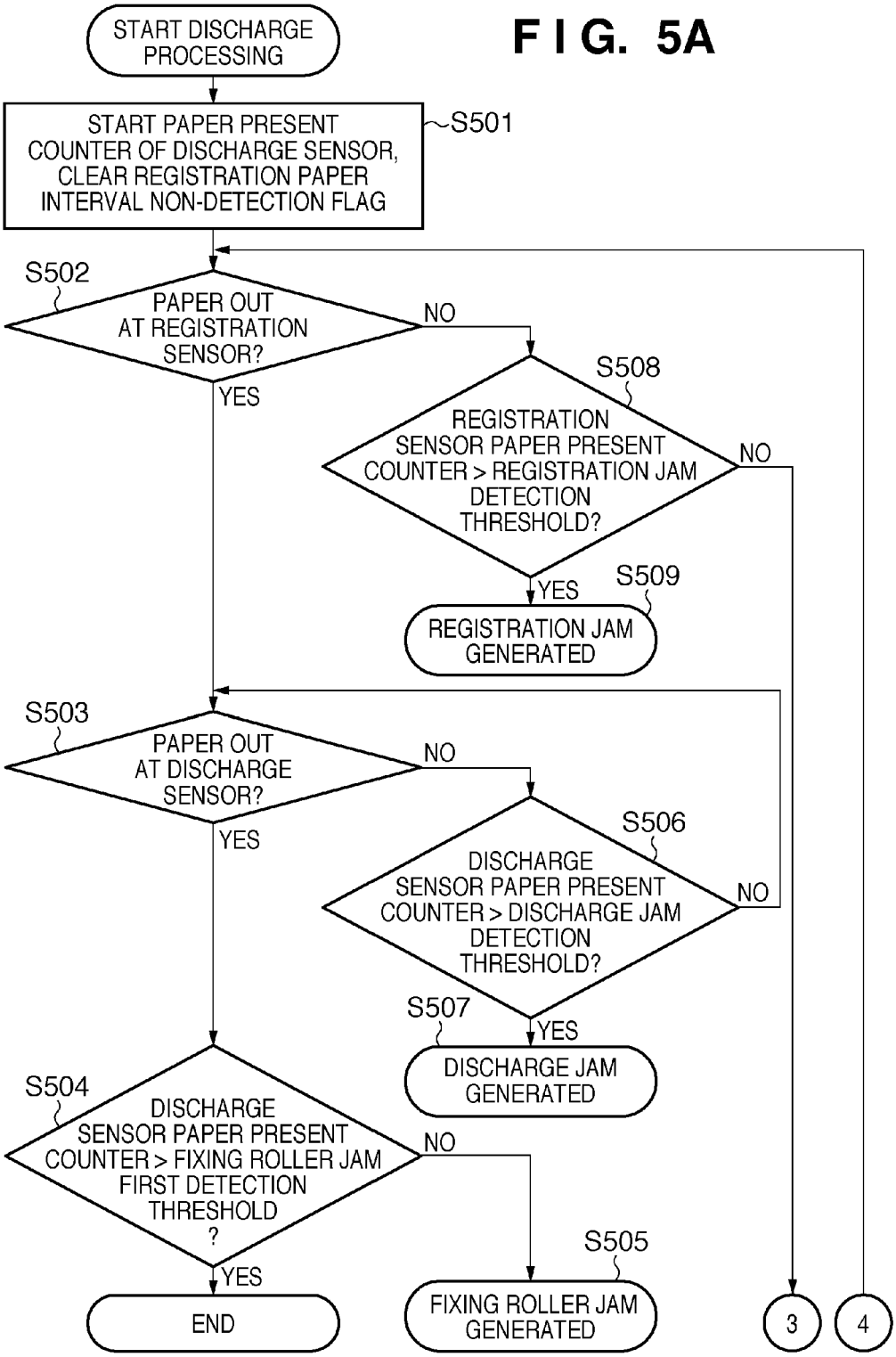
FIGS. 5A and 5B are a flowchart that shows a method for determining a jam in discharge processing according to a second embodiment.
Figure 5B:
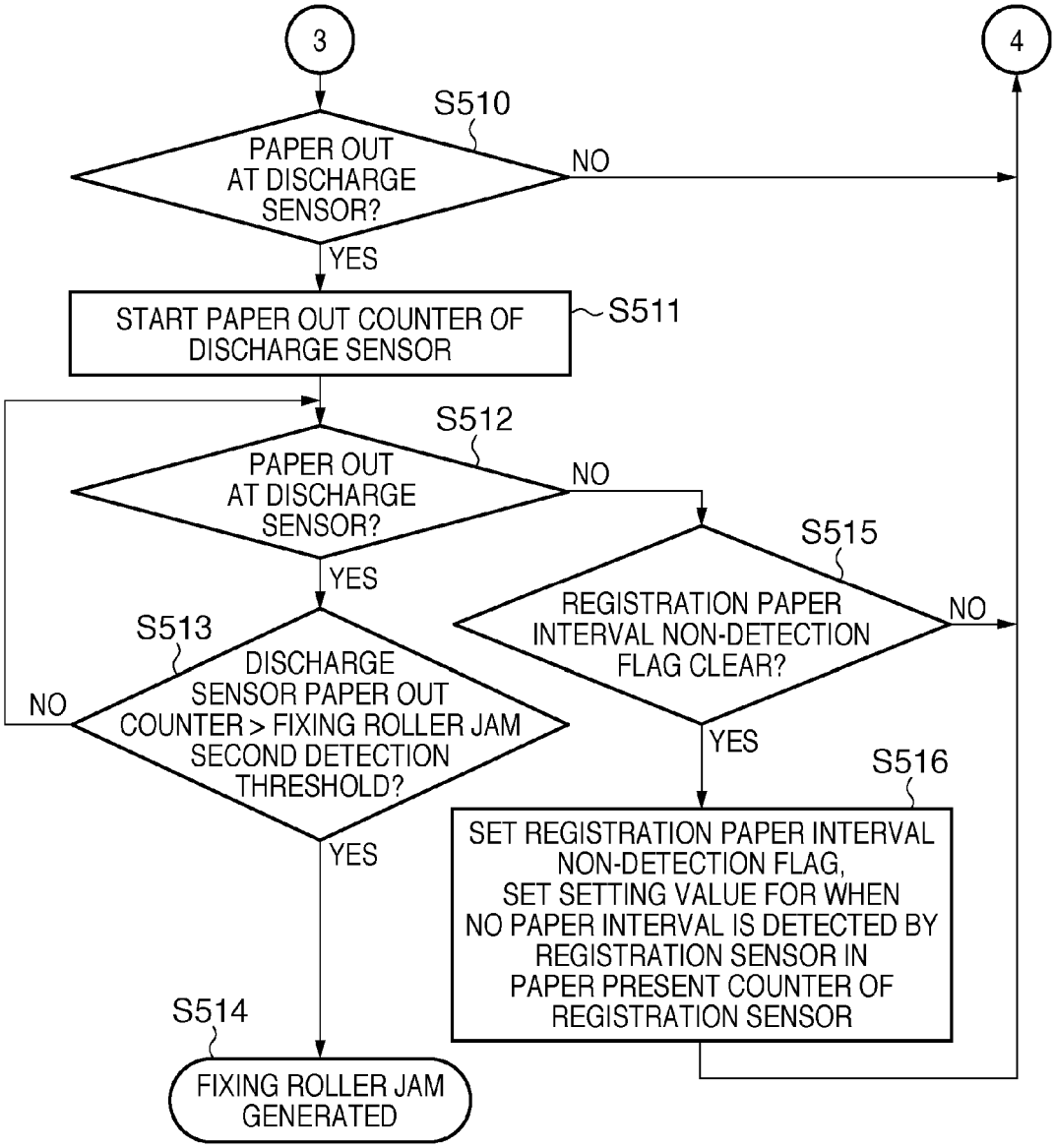

Next is description of a second embodiment, with reference to FIGS. 5A and 5B. In the present embodiment, a jam determination method is described that differs from the above embodiment when an interval between papers cannot be detected by a sensor (the registration sensor S1) on the upstream side in the conveyance direction of the recording material, but can be detected by a sensor (the discharge sensor S2) on the downstream side in the conveyance direction. Specifically, in the present embodiment, a judgment is made using a paper out (an interval between papers) detection time of the discharge sensor S2. If that detection time is shorter than a predetermined time, it is judged that the recording material can be discharged and if that detection time is longer than the predetermined time, it is judged that a jam has been generated. Note that the image forming apparatus according to the present embodiment has the same configuration as in the first embodiment, and also, the feed-conveyance processing is the same as shown in FIG. 4A. Accordingly, a duplicate description is omitted, while discharge processing that differs from the first embodiment is described.

The flowchart shown in FIGS. 5A and 5B is started by step S410 in FIG. 4A. First, in step S501, the engine control unit 302 starts the paper present counter of the discharge sensor S2, and clears the registration paper interval non-detection flag. Next, in step S502, the engine control unit 302 determines whether or not the trailing edge of the recording material, that is, a recording material out state, was detected by the registration sensor S1. When a recording material out state is being detected, processing proceeds to step S503, where the engine control unit 302 determines whether or not the trailing edge of the recording material, that is, a recording material out state, has been detected by the discharge sensor S2. Furthermore, when a recording material out state has been detected, processing proceeds to step S504, where the engine control unit 302 compares the paper present counter of the discharge sensor S2 to a first detection threshold of a fixing roller jam to the fixing roller 211. The first detection threshold of a fixing roller jam to the fixing roller 211 is a value determined according to a recording material conveyance time that corresponds to a length from the trailing edge detection position of the registration sensor S1 to the trailing edge detection position of the discharge sensor S2, and a margin amount. That is, the first detection threshold is determined based on an interval between consecutively conveyed papers of the recording material, and the recording material conveyance speed.

Here, when the paper present counter of the discharge sensor S2 has reached the first detection threshold, the engine control unit 302 judges that the recording material was normally discharged outside of the image forming apparatus, and ends the discharge processing. When the paper present counter of the discharge sensor S2 has not reached the first detection threshold, the engine control unit 302 judges that a fixing roller jam to the fixing roller 211 has been generated, and ends the discharge processing.

When a recording material out state has not been detected by the discharge sensor S2 in step S503, processing proceeds to step S506, where the engine control unit 302 compares the paper present counter of the discharge sensor S2 to the discharge jam detection threshold. Here, when the paper present counter of the discharge sensor S2 has not reached the discharge jam detection threshold, processing returns to step S503. On the other hand, when the paper present counter of the discharge sensor S2 has reached the discharge jam detection threshold, processing proceeds to step S507, where the engine control unit 302 judges that a jam has been generated in the vicinity of the discharge sensor S2, and ends the discharge processing. That is, if a recording material present state is detected by the discharge sensor S2 even after the discharge jam detection threshold has passed, the engine control unit 302 judges that a discharge congestion jam has been generated.

When a recording material out state has not been detected by the registration sensor S1 in step S502, processing proceeds to step S508, where the engine control unit 302 compares the paper present counter of the registration sensor S1 to the registration jam detection threshold. When the paper present counter of the registration sensor S1 has reached the registration jam detection threshold, processing proceeds to step S509, where the engine control unit 302 judges that a jam has been generated in the vicinity of the registration sensor S1, and ends the discharge processing. That is, if a recording material present state is detected by the registration sensor S1 even after the registration jam detection threshold has passed, the engine control unit 302 judges that a registration congestion jam has been generated.

On the other hand, when the paper present counter of the registration sensor S1 has not reached the registration jam detection threshold, processing proceeds to step S510, where the engine control unit 302 determines whether or not a recording material out state is being detected by the discharge sensor S2. When a recording material out state is not being detected, processing returns to step S502. On the other hand, when a recording material out state is being detected by the discharge sensor S2, processing proceeds to step S511, where the engine control unit 302 starts a paper out counter of the discharge sensor S2. The paper out counter of the discharge sensor S2 is a counter for measuring the time period that a paper out state is being detected by the discharge sensor S2, and is incremented at each occurrence of a certain time period.

Next, in step S512, the engine control unit 302 determines whether or not the discharge sensor S2 is detecting a recording material out state. When a recording material out state is being detected, processing proceeds to step S513, where the engine control unit 302 determines whether or not the paper out counter of the discharge sensor S2 has reached a second detection threshold of a fixing roller jam to the fixing roller 211. Here, the second detection threshold of a fixing roller jam to the fixing roller 211 is determined according to the time of the smallest interval between papers that can be detected by the discharge sensor S2, the time of the smallest interval between papers that can be detected by the registration sensor S1, the type of recording material, and the conveyance speed of the recording material.

When the paper out counter of the discharge sensor S2 has reached the second detection threshold, processing proceeds to step S514, where the engine control unit 302 judges that a fixing roller jam to the fixing roller 211 has been generated, and ends the discharge processing. On the other hand, when the paper out counter of the discharge sensor has not reached the second detection threshold, processing returns to step S512.

When the discharge sensor S2 is not detecting a recording material out state in step S512, processing proceeds to step S515, where the engine control unit 302 determines whether or not the registration paper interval non-detection flag is clear (unset). Here, when that flag is clear, processing proceeds to step S516, where the engine control unit 302 sets the registration paper interval non-detection flag, and in order to not cause generation of a registration jam, sets the setting value for when no paper interval is detected by the registration sensor S1 in the paper present counter of the registration sensor S1. On the other hand, if the registration paper interval non-detection flag is set, processing returns to step S502.

As described above, according to the image forming apparatus 201 of the present embodiment, when an interval between consecutively conveyed recording materials cannot be detected by the registration sensor S1, but can be detected by the discharge sensor S2, mistaken detection of a jam can be reduced. Also, in the present embodiment, even in a case where an interval between papers has not been detected by the registration sensor S1, but has been detected by the discharge sensor S2, it is possible to prevent mistaken detection of a fixing roller jam to the fixing roller 211 using the paper out detection time of the discharge sensor S2.

Third Embodiment

Figure 6:
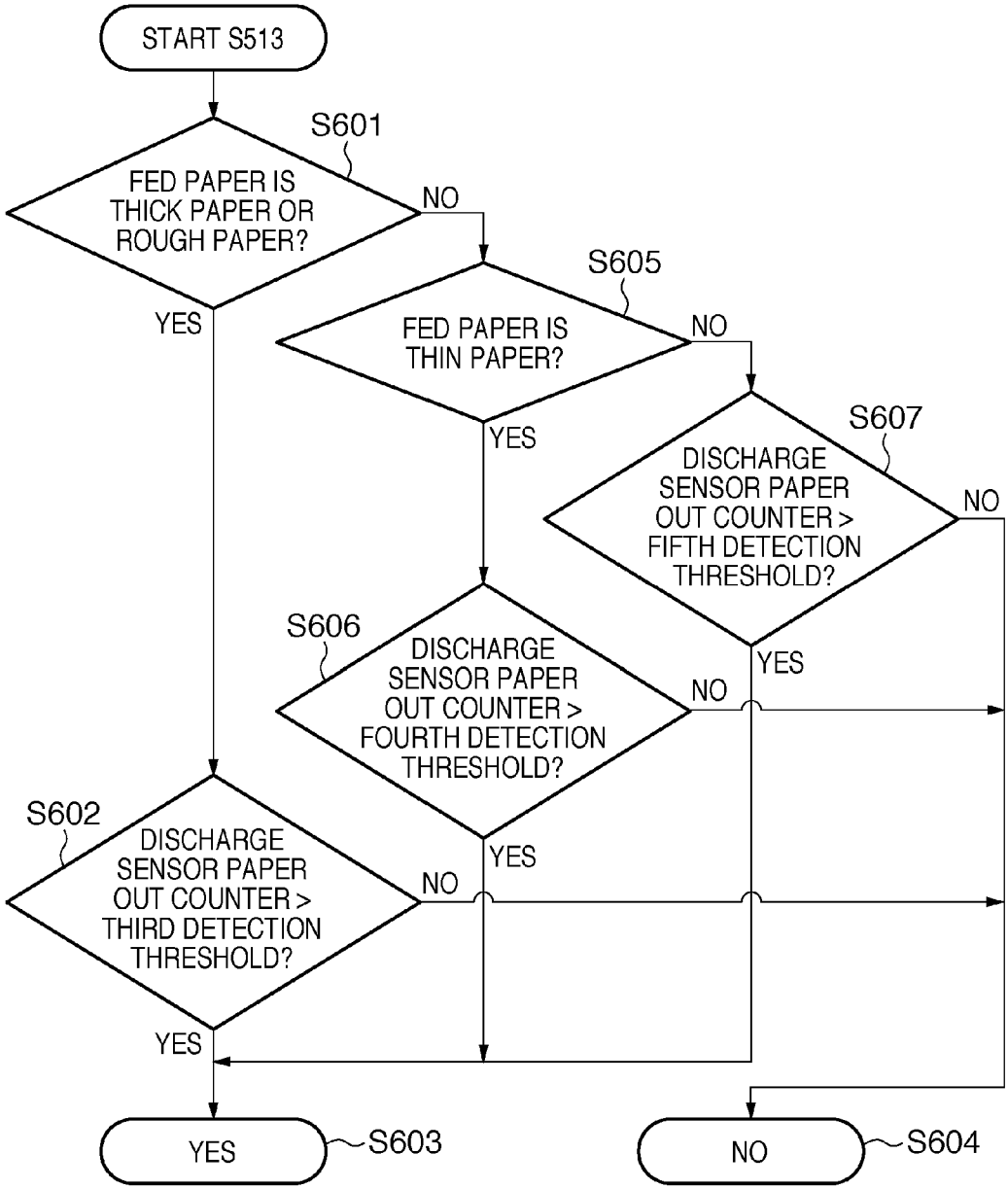
FIG. 6 is a flowchart that shows a method for determining a jam in consideration of the type of recording material according to a third embodiment.

Next is description of a third embodiment, with reference to FIG. 6. In the present embodiment, the detection threshold for determining whether to set a jam determination as valid or as invalid is changed according to the type of recording material. In the present embodiment, the processing of step S513 in FIGS. 5A and 5B of the second embodiment is described in detail. That is, a detailed description is given of processing for determining whether or not a fixing roller jam to the fixing roller 211 has been generated. Accordingly, because other configuration and control according to the present embodiment is the same as in the second embodiment, a description thereof is omitted here. Also note that a third detection threshold (a first length of time), a fourth detection threshold (a third length of time), and a fifth detection threshold (a second length of time) mentioned below each have different values, and are included in the second detection threshold, which is the detection threshold of a fixing roller jam to the fixing roller 211.

First, in step S601, the engine control unit 302, functioning as a recording material type detection unit, determines whether or not the type of recording material that has been fed is thick paper or rough paper. If the type of recording material is either thick paper or rough paper, processing proceeds to step S602, where the engine control unit 302 compares the paper out counter of the discharge sensor S2 to the third detection threshold of a fixing roller jam to the fixing roller 211. Here, when the paper out counter of the discharge sensor S2 has reached the third detection threshold, processing proceeds to step S603, where the engine control unit 302 executes the YES processing of step S513. On the other hand, when the paper out counter of the discharge sensor S2 has not reached the third detection threshold, processing proceeds to step S604, where the engine control unit 302 executes the NO processing of step S513.

When the type of recording material that was fed is neither thick paper or rough paper in step S601, processing proceeds to step S605, where the engine control unit 302 determines whether or not the recording material that was fed is thin paper. If the recording material that was fed is thin paper, processing proceeds to step S606, where the engine control unit 302 compares the paper out counter of the discharge sensor S2 to the fourth detection threshold of a fixing roller jam to the fixing roller 211. Here, when the paper out counter of the discharge sensor S2 has reached the fourth detection threshold, processing proceeds to step S603, where the engine control unit 302 executes the YES processing of step S513. On the other hand, when the paper out counter of the discharge sensor S2 has not reached the fourth detection threshold, processing proceeds to step S604, where the engine control unit 302 executes the NO processing of step S513.

When the recording material that was fed is not thin paper in step S605, processing proceeds to step S607, where the engine control unit 302 compares the paper out counter of the discharge sensor S2 to the fifth detection threshold of a fixing roller jam to the fixing roller 211. Here, when the paper out counter of the discharge sensor S2 has reached the fifth detection threshold, processing proceeds to step S603, where the engine control unit 302 executes the YES processing of step S513. On the other hand, when the paper out counter of the discharge sensor S2 has not reached the fifth detection threshold, processing proceeds to step S604, where the engine control unit 302 executes the NO processing of step S513.

Among the above-described detection thresholds of a fixing roller jam to the fixing roller 211, the third detection threshold is the largest value, and the fourth detection threshold is the smallest value. That is, these detection thresholds have a relationship as follows: third detection threshold (first time)>fifth detection threshold (third time)>fourth detection threshold (second time).

As described above, in the present embodiment, when an interval between papers cannot be detected by the registration sensor S1, but can be detected by the discharge sensor S2, by considering the paper out detection time of the discharge sensor S2 and the type of recording material that was fed, it is possible to further improve the accuracy of jam determination. Note that here, the present embodiment was described as a variation of the second embodiment, but the present embodiment is also applicable in combination with the first embodiment. In this case, the detection end threshold of a fixing roller jam to the fixing roller 211 used in the determination in step S433 of FIGS. 4B and 4C may be provided for each type of recording material, as described above. Also, although determination of the type of recording material is not specifically described in the present embodiment, such determination may be performed using a recording material type detection sensor as disclosed in Japanese Patent Laid-Open No. 2002-182518, or a recording material type that has been designated by a user may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-112663 filed on May 14, 2010, and No. 2011-029088 filed on Feb. 14, 2011, which are hereby incorporated by reference herein in their entirety.

What is claimed is:

1. A jam detecting apparatus, comprising:

a first detection unit that, when a plurality of recording materials are continuously conveyed, detects an interval between a trailing edge of a preceding conveyed recording material and a leading edge of a next subsequently conveyed recording material;

a second detection unit that is disposed on a downstream side in a conveyance direction of the recording material relative to the first detection unit, and is configured to detect a shorter interval than that the first detection unit can detect;

a setting unit that, after the leading edge of the subsequently conveyed recording material has been detected by the second detection unit, sets information indicating generation of a jam of the subsequently conveyed recording material; and a control unit that determines whether or not a jam has been generated based on the information set by the setting unit when the interval has not been detected by the first detection unit and the interval has been detected by the second detection unit, and thereafter the subsequently conveyed recording material is no longer detected by the second detection unit.

2. A jam detecting apparatus according to claim 1, wherein the control unit judges that the jam has been generated if the information has been set, and judges that the jam has not been generated if the information has not been set, when the interval has not been detected by the first detection unit and the interval has been detected by the second detection unit, and thereafter the subsequently conveyed recording material is no longer detected by the second detection unit.

3. A jam detecting apparatus according to claim 1, wherein the control unit judges that the jam has not been generated if the information has been set, and judges that the jam has been generated if the information has not been set, when the interval has not been detected by the first detection unit and the interval has been detected by the second detection unit, and thereafter the subsequently conveyed recording material is no longer detected by the second detection unit.

4. A jam detecting apparatus according to claim 1, wherein the control unit switches setting of the information if a presence of the subsequently conveyed recording material is detected by the first detection unit and the second detection unit for a predetermined time period.

5. A jam detecting apparatus, comprising:

a first detection unit that, when a plurality of recording materials are continuously conveyed, detects an interval between a trailing edge of a preceding conveyed recording material and a leading edge of a next subsequently conveyed recording material;

a second detection unit that is disposed on a downstream side in a conveyance direction of the recording material relative to the first detection unit, and is configured to detect a shorter interval than that the first detection unit can detect;

a measurement unit that measures a time period that the recording material has been detected by the first detection unit or the second detection unit; and a control unit that, when the interval has not been detected by the first detection unit and the trailing edge of the preceding conveyed recording material has been detected by the second detection unit, uses the measurement unit to measure the time period from detection of the trailing edge of the preceding conveyed recording material until detection of the leading edge of the subsequently conveyed recording material, and determines whether or not a jam has been generated according to the measured time period.

6. A jam detecting apparatus according to claim 5, wherein when the trailing edge of the preceding conveyed recording material has been detected by the second detection unit, the control unit determines that a jam has been generated if a time period from detection of the trailing edge of the preceding conveyed recording material to detection of the leading edge of the subsequently conveyed recording material exceeds a preset threshold.

7. A jam detecting apparatus according to claim 6, further comprising a recording material type detection unit that detects a type of conveyed recording material, wherein the control unit changes the threshold according to the type of recording material detected by the recording material type detection unit.

8. A jam detecting apparatus according to claim 7, wherein the control unit:

determines that a jam has been generated, using a first threshold as the threshold, if the conveyed recording material is detected to be thick paper or rough paper by the recording material type detection unit;

determines that a jam has been generated, using a second threshold shorter than the first threshold as the threshold, if the conveyed recording material is detected to be thin paper by the recording material type detection unit; and determines that a jam has been generated, using a third threshold between the first threshold and the second threshold as the threshold, if the conveyed recording material is detected to be none of thick paper, rough paper, and thin paper by the recording material type detection unit.

9. An image forming apparatus, comprising:

a first detection unit that, when a plurality of recording materials are continuously conveyed, detects an interval between a trailing edge of a preceding conveyed recording material and a leading edge of a subsequently conveyed recording material;

a second detection unit that is disposed on a downstream side in a conveyance direction of the recording material relative to the first detection unit, and is configured to detect a shorter interval than that the first detection unit can detect;

a setting unit that, after the leading edge of the subsequently conveyed recording material has been detected by the second detection unit, sets information indicating generation of a jam of the subsequently conveyed recording material; and a control unit that determines whether or not a jam has been generated based on the information set by the setting unit when the interval has not been detected by the first detection unit and the interval has been detected by the second detection unit, and thereafter the subsequently conveyed recording material is no longer detected by the second detection unit, and an image forming unit between the first detection unit and the second detection unit.

10. The image forming apparatus according to claim 9, further comprising a rotational fixing member that is provided between the first detection unit and the second detection unit, and fixes to the recording material a toner image that has been formed on the recording material, wherein the jam is a jam in which the recording material wraps around the rotational fixing member.

11. A jam detecting apparatus, comprising:

a first detection unit that, when a plurality of recording materials are continuously conveyed, detects an interval between a trailing edge of a preceding conveyed recording material and a leading edge of a next subsequently conveyed recording material;

a second detection unit that is disposed on a downstream side in a conveyance direction of the recording material relative to the first detection unit, detects an interval between a trailing edge of a preceding conveyed recording material and a leading edge of a next subsequently conveyed recording material;

a control unit configured to determine that a jam has been generated based on a time period until the second detection unit does not detect the subsequently conveyed recording material after the first detection unit does not detect the interval and the second detection unit detects the interval.

12. A jam detecting apparatus according to claim 11, wherein the second detection unit detects an interval being shorter than the interval detected by the first detection unit.

13. An image forming apparatus, comprising:

a first detection unit that, when a plurality of recording materials are continuously conveyed, detects an interval between a trailing edge of a preceding conveyed recording material and a leading edge of a next subsequently conveyed recording material;

a second detection unit that is disposed on a downstream side in a conveyance direction of the recording material relative to the first detection unit, and is configured to detect a shorter interval than that the first detection unit is configured to detect;

a measurement unit that measures a time period that the recording material has been detected by the first detection unit or the second detection unit;

a control unit that, when the interval has not been detected by the first detection unit and the trailing edge of the preceding conveyed recording material has been detected by the second detection unit, uses the measurement unit to measure the time period from detection of the trailing edge of the preceding conveyed recording material until detection of the leading edge of the subsequently conveyed recording material, and determines whether or not a jam has been generated according to the measured time period; and an image forming unit between the first detection unit and the second detection unit.

14. The image forming apparatus according to claim 13, further comprising a rotational fixing member that is provided between the first detection unit and the second detection unit, and fixes to the recording material a toner image that has been formed on the recording material, wherein the jam is a jam in which the recording material wraps around the rotational fixing member.

15. An image forming apparatus, comprising:

a first detection unit that, when a plurality of recording materials are continuously conveyed, detects an interval between a trailing edge of a preceding conveyed recording material and a leading edge of a next subsequently conveyed recording material;

a second detection unit that is disposed on a downstream side in a conveyance direction of the recording material relative to the first detection unit, detects an interval between a trailing edge of a preceding conveyed recording material and a leading edge of a next subsequently conveyed recording material;

a control unit that determines that a jam has been generated based on a time period until the second detection unit does not detect the subsequently conveyed recording material after the first detection unit does not detect the interval and the second detection unit detects the interval; and an image forming unit between the first detection unit and the second detection unit.

16. The image forming apparatus according to claim 15, further comprising a rotational fixing member that is provided between the first detection unit and the second detection unit, and fixes to the recording material a toner image that has been formed on the recording material, wherein the jam is a jam in which the recording material wraps around the rotational fixing member.

* * * * *